US009446503B2

(12) United States Patent
Pearce et al.

(10) Patent No.: US 9,446,503 B2
(45) Date of Patent: Sep. 20, 2016

(54) HIGH-STRENGTH, HIGH-HARDNESS BINDERS AND DRILLING TOOLS FORMED USING THE SAME

(71) Applicant: LONGYEAR TM, INC., South Jordan, UT (US)

(72) Inventors: Cody A. Pearce, Midvale, UT (US); Christian M. Lambert, Draper, UT (US)

(73) Assignee: LONGYEAR TM, INC., Salt Lake City, UT (US)

( * ) Notice: Subject to any disclaimer, the term of this patent is extended or adjusted under 35 U.S.C. 154(b) by 0 days.

(21) Appl. No.: 14/566,389

(22) Filed: Dec. 10, 2014

(65) Prior Publication Data

US 2015/0089882 A1 Apr. 2, 2015

Related U.S. Application Data

(62) Division of application No. 13/280,977, filed on Oct. 25, 2011, now abandoned.

(51) Int. Cl.

| | |
|---|---|
| ***C22C 30/06*** | (2006.01) |
| ***B24D 3/06*** | (2006.01) |
| ***C22C 18/00*** | (2006.01) |
| ***C22C 30/04*** | (2006.01) |
| ***B24D 99/00*** | (2010.01) |

(Continued)

(52) U.S. Cl.

CPC ..... *B24D 3/06* (2013.01); *B24D 99/00* (2013.01); *C22C 9/04* (2013.01); *C22C 18/00* (2013.01); *C22C 26/00* (2013.01); *C22C 29/08* (2013.01); *C22C 30/02* (2013.01); *C22C 30/04* (2013.01); *C22C 30/06* (2013.01); *C22C 49/00* (2013.01); *E21B 10/46* (2013.01); *C22C 2204/00* (2013.01)

(58) Field of Classification Search

CPC ..... C22C 18/00
USPC ..... 75/255
See application file for complete search history.

(56) References Cited

U.S. PATENT DOCUMENTS 4,049,434 A * 9/1977 Sloboda et al. ..... 420/482
4,644,674 A 2/1987 Burrows et al.

(Continued)

FOREIGN PATENT DOCUMENTS

CN 1904306 A 1/2007
CN 1961090 A 5/2007

(Continued)

OTHER PUBLICATIONS

Divakar, et al., "High temperature lead-free solder: Phase relations in (Cu,Ni)—Sn—Zn", Sep. 12, 2010, 18 pages.

(Continued)

*Primary Examiner* — Jessee Roe
*Assistant Examiner* — Christopher Kessler
(74) *Attorney, Agent, or Firm* — Ballard Spahr LLP

(57) ABSTRACT

Implementations of the present invention include a binder with high hardness and tensile strength that allows for the creation of drilling tools with increased wear resistance. In particular, one or more implementations include a binder having about 5 to about 50 weight % of nickel, about 35 to about 60 weight % of zinc, and about 0.5 to about 35 weight % of tin. Implementations of the present invention also include drilling tools, such as reamers and drill bits, formed from such binders.

18 Claims, 8 Drawing Sheets

(51) Int. Cl.

| | |
|---|---|
| ***C22C 29/08*** | (2006.01) |
| ***C22C 30/02*** | (2006.01) |
| ***C22C 26/00*** | (2006.01) |
| ***C22C 49/00*** | (2006.01) |
| ***E21B 10/46*** | (2006.01) |
| ***C22C 9/04*** | (2006.01) |

(56) References Cited

U.S. PATENT DOCUMENTS

| | | | | |
|---|---|---|---|---|
| 5,000,273 | A | 3/1991 | Horton et al. | |
| 6,254,701 | B1 * | 7/2001 | Oshiro et al. | 148/432 |
| 7,628,228 | B2 | 12/2009 | Drivdahl et al. | |
| 8,459,381 | B2 | 6/2013 | Pearce et al. | |
| 2001/0002557 | A1 * | 6/2001 | Kembaiyan et al. | 75/240 |
| 2004/0091385 | A1 | 5/2004 | Leyendecker et al. | |
| 2004/0244540 | A1 | 12/2004 | Oldham et al. | |
| 2007/0092727 | A1 | 4/2007 | Kosters et al. | |
| 2008/0289880 | A1 | 11/2008 | Majagi et al. | |
| 2010/0263938 | A1 | 10/2010 | Scott | |
| 2011/0067924 | A1 | 3/2011 | Lambert et al. | |
| 2013/0098691 | A1 | 4/2013 | Pearce et al. | |

FOREIGN PATENT DOCUMENTS

| | | | |
|---|---|---|---|
| CN | 101100930 | A | 1/2008 |
| CN | 101198762 | A | 6/2008 |
| CN | 103917733 | A | 7/2014 |
| EP | 1077268 | A1 | 2/2001 |
| EP | 2771533 | A1 | 9/2014 |
| WO | WO-2006/076795 | A1 | 7/2006 |
| WO | WO-2013/062536 | A1 | 5/2013 |

OTHER PUBLICATIONS

Wnuk et al., "Microstructural and thermal analysis of Cu—Ni—Sn—Zn alloys by means of SEM and DSC techniques", Archives of Materials Science and Engineering, vol. 40, Nov. 1, 2009, pp. 27-32.

Gandova, et al., "Thermochemical and phase diagram studies of the Sn—Zn—Ni system" Thermochimica Acta 524 (2011) pp. 47-55.

Requirement for Restriction or Election issued on Oct. 31, 2013 for U.S. Appl. No. 13/280,977, filed Oct. 25, 2011 and published as US-2013-0098691-A1 on Apr. 25, 2013 (Applicant—Boart Longyear // Inventor—Pearce, et al.) (8 pages).

Response to Requirement for Restriction or Election filed on Nov. 27, 2013 for U.S. Appl. No. 13/280,977, filed Oct. 25, 2011 and published as US-2013-0098691-A1 on Apr. 25, 2013 (Applicant—Boart Longyear // Inventor—Pearce, et al.) (4 pages).

Non-Final Office Action issued on Dec. 19, 2013 for U.S. Appl. No. 13/280,977, filed Oct. 25, 2011 and published as US-2013-0098691-A1 on Apr. 25, 2013 (Applicant—Boart Longyear // Inventor—Pearce, et al.) (11 pages).

Amendment and Response to Non-Final Office Action filed on Mar. 19, 2014 for U.S. Appl. No. 13/280,977, filed Oct. 25, 2011 and published as US-2013-0098691-A1 on Apr. 25, 2013 (Applicant—Boart Longyear // Inventor—Pearce, et al.) (10 pages).

Applicant Initiated Interview Summary issued on Aug. 25, 2014 for U.S. Appl. No. 13/280,977, filed Oct. 25, 2011 and published as US-2013-0098691-A1 on Apr. 25, 2013 (Applicant—Boart Longyear // Inventor—Pearce, et al.) (4 pages).

Final Office Action issued on Sep. 10, 2014 for U.S. Appl. No. 13/280,977, filed Oct. 25, 2011 and published as US-2013-0098691-A1 on Apr. 25, 2013 (Applicant—Boart Longyear // Inventor—Pearce, et al.) (14 pages).

International Search Report issued by the International Searching Authority on Oct. 20, 2012 for international application PCT/US2011/057830, filed on Oct. 26, 2011 and published as WO 2013/062536 on May 2, 2013 (Applicant—Longyear TM, Inc. // Inventor—Pearce, et al.) (3 pages).

Written Opinion of the International Searching Authority issued on Oct. 30, 2012 for international application PCT/US2011/057830, filed on Oct. 26, 2011 and published as WO 2013/062536 on May 2, 2013 (Applicant—Longyear TM, Inc. // Inventor—Pearce, et al.) (5 pages).

International Preliminary Report on Patentability issued by the International Searching Authority on Apr. 29, 2014 for international application PCT/US2011/057830, filed on Oct. 26, 2011 and published as WO 2013/062536 on May 2, 2013 (Applicant—Longyear TM, Inc. // Inventor—Pearce, et al.) (6 pages).

Extended European Search Report issued Apr. 1, 2015 for European Patent Application No. 11874767.4, which was filed on Oct. 26, 2011 and published as EP 2771533 on Sep. 3, 2014 (Inventor—Pearce; Applicant—Longyear TM, Inc.; (pp. 1-6).

* cited by examiner

HIGH-STRENGTH, HIGH-HARDNESS BINDERS AND DRILLING TOOLS FORMED USING THE SAME

CROSS-REFERENCE TO RELATED APPLICATIONS

This application is a divisional of U.S. patent application Ser. No. 13/280,977 filed Oct. 25, 2011, now abandoned, which is hereby incorporated herein by reference in its entirety.

BACKGROUND OF THE INVENTION

1. The Field of the Invention

The present invention generally relates to a high-strength binder material for forming drilling tools and other tools that may be used to drill subterranean formations.

2. Discussion of the Relevant Art

Drill bits and other earth-boring tools are often used to drill holes in rock and other hard formations for exploration or other purposes. The body of these tools is commonly formed of a matrix that contains a powdered hard particulate material, such as tungsten carbide. This material is typically infiltrated with a binder, such as a copper alloy, to bind the hard particulate material together into a solid form. Finally, the cutting portion of these tools typically includes an abrasive cutting media, such as for example, natural or synthetic diamonds.

To form the body, the powdered hard particulate material is placed in a mold of suitable shape. The binder is typically placed on top of the powdered hard particulate material. The binder and the powdered hard particulate material are then heated in a furnace to a flow or infiltration temperature of the binder so that the binder alloy can bond to the grains of powdered hard particulate material. Infiltration can occur when the molten binder alloy flows through the spaces between the powdered hard particulate material grains by means of capillary action. When cooled, the powdered hard particulate material matrix and the binder form a hard, durable, strong body. Typically, natural or synthetic diamonds are inserted into the mold prior to heating the matrix/binder mixture, while PDC inserts can be brazed to the finished body.

The compositions of the matrix and binder are often selected to optimize a number of different properties of the finished body. These properties can include transverse rupture strength (TRS), toughness, tensile strength, and hardness. One important property of the binder is the binder's infiltration temperature, or the temperature at which molten binder will flow in and around the powdered hard particulate material. The chemical stability of the diamonds is inversely related to the duration of heating of the diamonds and the temperature to which the diamonds are heated as the body is formed. Thus, when forming diamond drilling tools, it is desirable to use a binder with a low enough infiltration temperature to avoid diamond degradation.

Binder alloys with low infiltration temperatures are known in the art; however, such binders often sacrifice one or more of tensile strength, hardness, and other desirable properties at the expense of a lower infiltration temperature. For example, many conventional copper-tin alloys have a low infiltration temperature, but also have relatively low tensile strength. On the other hand, many conventional copper-zinc-nickel alloys have a low infiltration temperature with a relatively high tensile strength, but also have a relatively low hardness.

In some cases, drilling tools may be expensive and their replacement may be time consuming, costly, as well as dangerous. For example, the replacement of a drill bit requires removing (or tripping out) the entire drill string from a hole that has been drilled (the borehole). Each section of the drill rod must be sequentially removed from the borehole. Once the drill bit is replaced, the entire drill string must be assembled section by section, and then tripped back into the borehole. Depending on the depth of the hole and the characteristics of the materials being drilled, this process may need to be repeated multiple times for a single borehole. Thus, one will appreciate that the more times a drill bit or other drilling tool needs to be replaced, the greater the time and cost required to perform a drilling operation.

Accordingly, there are a number of disadvantages in conventional drilling tools that can be addressed.

BRIEF SUMMARY OF THE INVENTION

Implementations of the present invention overcome one or more problems in the art with binders with a low-infiltration temperature without sacrificing other desirable physical properties. For instance, one or more implementations include a nickel-zinc-tin ternary alloy binder with a low infiltration-temperature and relatively high tensile strength and relatively high hardness. One or more addition implementations include a copper-nickel-zinc-tin quaternary alloy binder with a low infiltration-temperature and relatively high tensile strength and relatively high hardness. Implementations of the present invention also include drilling tools including such binders.

For example, an implementation of high hardness binder for infiltrating a hard particulate material to form a drilling tool. The binder includes about 5 to about 50 weight % of nickel, about 25 to about 60 weight % of zinc, and about 0.5 to about 35 weight % of tin. The binder has a liquidus temperature of less than about 1100 degrees Celsius. Additionally, the binder has a hardness between about 75 on the Rockwell Hardness B scale ("HRB") and about 40 on the Rockwell Hardness C scale ("HRC").

Another implementation of the present invention includes a body of a drilling tool that comprises a hard particulate material infiltrated with a binder. The binder includes about 5 to about 50 weight % of nickel, about 25 to about 60 weight % of zinc, and about 0.5 to about 35 weight % of tin.

In addition to the foregoing, an implementation of a method of forming a drilling tool with increased wear resistance involves providing a matrix comprising a hard particulate material. The method also includes positioning a binder proximate the matrix. The binder includes about 5 to about 50 weight % of nickel, about 25 to about 60 weight % of zinc, and about 0.5 to about 35 weight % of tin. The method further involves infiltrating the matrix with the binder by heating the matrix and binder to a temperature of no greater than about 1200 degrees Celsius.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures may not be drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
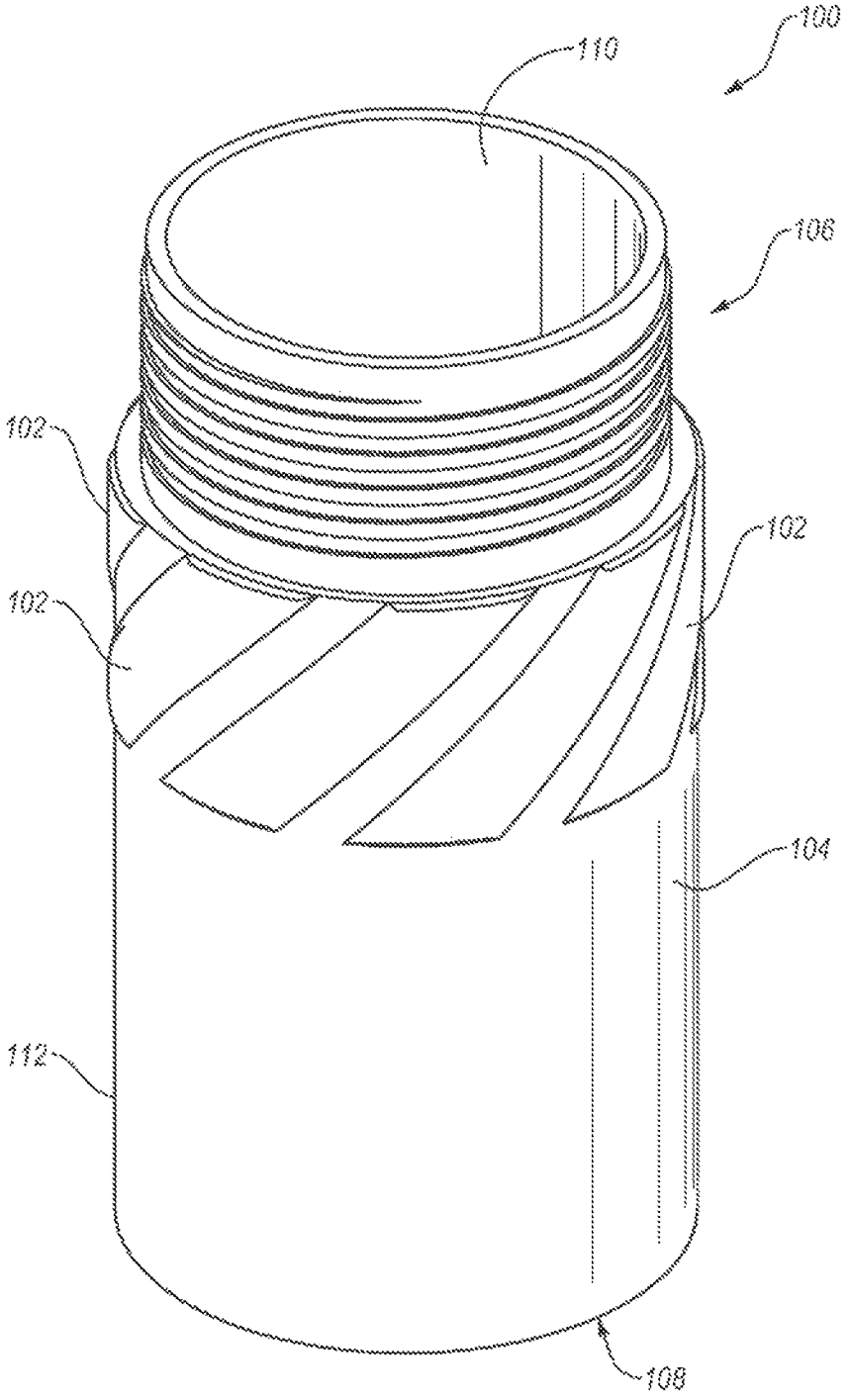
FIG. 1 illustrates a reaming shell including a binder in accordance with one or more implementations of the present invention.

Implementations of the present invention are directed towards binders with a low-infiltration temperature without sacrificing other desirable physical properties. For instance, one or more implementations include a nickel-zinc-tin ternary alloy binder with a low infiltration-temperature and relatively high tensile strength and relatively high hardness. One or more addition implementations include a copper-nickel-zinc-tin quaternary alloy binder with a low infiltration-temperature and relatively high tensile strength and relatively high hardness. Implementations of the present invention also include drilling tools including such binders.

As alluded to earlier, one or more binders of the present invention can have both a high tensile strength and a high hardness, while still having an infiltration temperature suitable for use with natural and synthetic diamonds. Additionally, one or more binders of the present invention include increased wetting abilities for tungsten carbide or other hard particulate materials. The increased wettability of one or more binders of the present invention can reducing processing times and can increase bond strength.

As binders often limit the performance of drilling tools, drilling tools formed with binders of the present invention can have increased drilling performance. For example, the increased hardness and/or tensile strength of one or more binders can provide drilling tools with increased wear resistance. The increased wear resistance of drilling tools formed using binders of the present invention can increase the drilling life of such drilling tools; thereby, reducing drilling costs.

One or more binders of the present invention include about 5 to about 50 weight % of nickel, about 25 to about 60 weight % of zinc, and about 0.5 to about 35 weight % of tin. In one or more implementations, the binder can optionally include about 0 to about 60 weight % of copper. Thus, in one or more implementations the binder can comprise a nickel-zinc-tin ternary alloy. In one or more alternative implementations the binder can comprise a copper-nickel-zinc-tin quaternary alloy. One will appreciate that the exact weight percentage of each of the above listed components can be altered to tailor the characteristics of the final drilling tool.

For example, the weight % of nickel in the binder can be increased, or otherwise modified, to increase the wetting abilities of the binder to the hard particulate material (e.g., tungsten carbide) and/or diamonds, or otherwise tailor additional properties of the binder. Thus, according to one or more implementations the binder can include about 5 weight % of nickel, about 10 weight % of nickel, about 15 weight % of nickel, about 20 weight % of nickel, about 25 weight % of nickel, about 30 weight % of nickel, about 35 weight % of nickel, about 40 weight % of nickel, about 45 weight % of nickel, or about 50 weight % of nickel. One will appreciate that binders of one or more implementations can include a weight % of nickel in a range between any of the above recited percentages. For instance, one or more implementations can include between about 15 and about 50 weight % of nickel, between about 5 and about 30 weight % of nickel, between about 5 and about 20 weight % of nickel, or between about 10 and about 25 weight % of nickel, etc.

The weight % of zinc in the binder can be increased, or otherwise modified, to increase the strength and ductility of the binder, or otherwise tailor additional properties of the binder. Thus, according to one or more implementations the binder can include about 25 weight % of zinc, about 30 weight % of zinc, about 35 weight % of zinc, about 40 weight % of zinc, about 45 weight % of zinc, about 50 weight % of zinc, about 55 weight % of zinc, or about 60 weight % of zinc. One will appreciate that binders of one or more implementations can include a weight % of zinc in a range between any of the above recited percentages. For instance, one or more implementations can include between about 30 and about 60 weight % of zinc, between about 35 and about 50 weight % of zinc, between about 30 and about 40 weight % of zinc, or between about 35 and about 45 weight % of zinc, etc.

The weight % of tin in the binder can be increased, or otherwise modified, to increase the hardness, lower the liquidus temperature, increase the wettability of the binder, or otherwise tailor additional properties of the binder. Thus, according to one or more implementations the binder can include about 0.5 weight % of tin, about 1 weight % of tin, about 2 weight % of tin, about 3 weight % of tin, about 4 weight % of tin, about 5 weight % of tin, about 10 weight % of tin, about 15 weight % of tin, about 20 weight % of tin, about 25 weight % of tin, about 30 weight % of tin, or about 35 weight % of tin. One will appreciate that binders of one or more implementations can include a weight % of tin in a range between any of the above recited percentages. For instance, one or more implementations can include between about 0.5 and about 20 weight % of tin, between about 1 and about 10 weight % of tin, between about 4 and about 15 weight % of tin, or between about 5 and about 10 weight % of tin, etc.

As previously mentioned, in one or more implementations the binder can optionally include about 0 to about 60 weight % of copper. The weight % of copper in the binder can be increased, or otherwise modified, to decrease the liquidus temperature of the binder, or otherwise tailor additional properties of the binder. Thus, according to one or more implementations the binder can include about 10 weight % of copper, about 10 weight % of copper, about 15 weight % of copper, about 20 weight % of copper, about 25 weight % of copper, about 30 weight % of copper, about 35 weight % of copper, about 40 weight % of copper, about 45 weight % of copper, about 50 weight % of copper, or about 55 weight % of copper. One will appreciate that binders of one or more implementations can include a weight % of copper in a range between any of the above recited percentages. For instance, one or more implementations can include between about 15 and about 50 weight % of copper, between about 5 and about 30 weight % of copper, between about 5 and about 20 weight % of copper, or between about 10 and about 25 weight % of copper, etc. In alternative implementations, the binder may not include copper.

In one or more implementations of the present invention, the binder can include additional components other than nickel, zinc, tin, and optionally copper. Such additional components can include additional alloying components, impurities, or tramp elements. In one or more implementations such additional components can comprise about 0 to about 20 weight % of the binder. In further implementations, such additional components can comprise less than about 15 weight % of the binder, less than about 10 weight % of the binder, or less than about 5 weight % of the binder.

In one or more implementation, the additional component (s) can include a thermally conductive metal to lower the liquidus temperature of the binder. Such thermally conductive metals can include, for example, silver, gold, or gallium (or mixtures thereof). For example, according to some implementations of the present invention, the binder can include between about 0.5 to about 15 weight % silver, gold, or gallium. One will appreciate that the inclusion of silver, gold, or gallium can significantly raise the cost of the binder.

Alternatively, or additionally, in one or more implementations the additional component(s) can include further alloying components such as iron, manganese, silicon, boron, or other elements or metals. Additionally, the binder can include minor amounts of various impurities or tramp elements, at least some of which may necessarily be present due to manufacturing and handling processes. Such impurities can include, for example, aluminum, lead, silicon, and phosphorous.

In any event, the composition of the various components can be tailor to provide the binder with desirable properties. For example, in one or more implementations the binder has a liquidus temperature of less than about 1100 degrees Celsius. Alternatively, the binder has a liquidus temperature of less than about 1050 degrees Celsius. In further implementations, the binder has a liquidus temperature of less than about 1000 degrees Celsius. In further implementations, the binder has a liquidus temperature of less than about 950 degrees Celsius. Thus, one will appreciate that the binder can include a liquidus temperature low enough to ensure that the infiltration temperature of the binder is low enough to avoid diamond degradation.

As previously alluded to, binders of one or more implementations of the present invention can have high tensile strength and hardness while maintaining a liquidus temperature that will avoid diamond degradation. In particular, in one or more implementations the binder has a hardness between about 75 HRB and about 40 HRC. In further implementations the binder can have a hardness between about 75 HRB and about 20 HRC. In still further implementations the binder can have a hardness between about 80 HRB and about 95 HRB. One will appreciate that binders of one or more implementations can include a hardness in a range between any of the above recited numbers.

Additionally, binders of one or more implementations can also have a tensile strength between about 35 ksi and about 80 ksi, in addition to a liquidus temperatures and hardness as mentioned above. In further implementations the binder can have a tensile strength between about 50 ksi and about 70 ksi. In still further implementations the binder can have a tensile strength of between about 55 ksi and about 65 ksi. One will appreciate that binders of one or more implementations can include a tensile strength in a range between any of the above recited numbers.

One will appreciate that binders of one or more implementations of the present invention that have high tensile strength and hardness while maintaining a liquidus temperature that will avoid diamond degradation can provide significant benefits. In particular, the high tensile strength and hardness can provide a drilling tool formed with such a binder with increased wear resistance. The increase in wear resistance can significantly improve the life of such drilling tools. In addition, the improved wetting can reduce manufacturing time and provide a stronger bond.

Thus, the binders of the present invention can be tailored to provide the drilling tools of the present invention with several different characteristic that can increase the useful life and/or the drilling efficient of the drilling tools. For example, the composition of the binder can be tailored to vary the tensile strength and hardness, and thus, the wear resistance of the drilling tool. One will thus appreciate that by modifying the composition of the binder, the wear resistance can be tailored to the amount needed for the particular end use of the drilling tool. This increased properties provided by binders of one or more implementations can also increase the life of a drilling tool, allowing the cutting portion of the tools to wear at a desired pace and improving the rate at which the tool cuts.

The following example present the results of one exemplary binder created in accordance with the principles of the present invention. This example is illustrative of the invention claimed herein and should not be construed to limit in any way the scope of the invention.

EXAMPLE

A binder was formed with 42.62 weight % of copper, 10 weight % of nickel, 5 weight % of tin, 42 weight % of zinc, and 0.38 weight % of silicon. The binder had a tensile strength of 58.5 ksi, a hardness of HRB 90, and a liquidus temperature of about 926 degrees Celsius. Thus, the binder had both high tensile strength and hardness, while maintaining a liquidus temperature below 950 degrees Celsius. The binder was used to create a reamer with improved properties.

Infiltrated drilling tools of the present invention can be formed from a plurality of abrasive cutting media, a matrix material, and a binder as described above. The binder can be configured to tailor the properties of the drilling tools. The drilling tools described herein can be used to cut stone, subterranean mineral formations, ceramics, asphalt, concrete, and other hard materials. These drilling tools may include, for example, core sampling drill bits, drag-type drill bits, roller cone drill bits, diamond wire, grinding cups, diamond blades, tuck pointers, crack chasers, reamers, stabilizers, and the like. For example, the drilling tools may be any type of earth-boring drill bit (i.e., core sampling drill bit, drag drill bit, roller cone bit, navi-drill, full hole drill, hole saw, hole opener, etc.), and so forth. The Figures and corresponding text included hereafter illustrate examples of some drilling tools including bodies infiltrated with binders of the present invention. This has been done for ease of description. One will appreciate in light of the disclosure herein; however, that the systems, methods, and apparatus of the present invention can be used with other drilling tools, such as those mentioned hereinabove.

Referring now to the Figures, FIG. 1 illustrates a first drilling tool 100 which can be formed using a binder of one or more implementations of the present invention. In particular, FIG. 1 illustrates a reaming shell 100. The reaming shell 100 can include one or more bodies 102 (i.e., pads) formed from a hard particulate material infiltrated with a binder of one or more implementations of the present invention.

The reaming shell 100 can also include a first or shank portion 104 with a first end 108 that is configured to connect the reaming shell to a component of a drill string. By way of example and not limitation, the shank portion 108 may be formed from steel, another iron-based alloy, or any other material that exhibits acceptable physical properties.

As shown in FIG. 1, the reaming shell 100 a generally annular shape defined by an inner surface 110 and an outer surface 112. Thus, the reaming shell 100 can define an interior space about its central axis for receiving a core sample. Accordingly, pieces of the material being drilled can pass through the interior space of the reaming shell 100 and up through an attached drill string. The reaming shell 100 may be any size, and therefore, may be used to collect core samples of any size. While the reaming shell 100 may have any diameter and may be used to remove and collect core samples with any desired diameter, the diameter of the reaming shell 100 can range m some implementations from about 1 inch to about 12 inches.

As shown by FIG. 1, in one or more implementations, the reaming shell 100 can include raised pads 102 separated by channels. In one or more implementations the pads 102 can have a spiral configuration. In other words, the pads 102 can extend axially along the shank 104 and radially around the shank 104. The spiral configuration of the pads 102 can provide increased contact with the borehole, increased stability, and reduced vibrations. In alternative implementations, the pads 102 can have a linear instead of a spiral configuration. In such implementations, the pads 102 can extend axially along the shank 104. Furthermore, in one or more implementations the pads 102 can include a tapered leading edge to aid in moving the reaming shell 100 down the borehole.

In some implementations, the reaming shell 100 may not include pads 102. For example, the reaming shell 100 can include broaches instead of pads. The broaches can include a plurality of strips. The broaches can reduce the contact of the reaming shell 100 on the borehole, thereby decreasing drag. Furthermore, the broaches can provide for increased water flow, and thus, may be particularly suited for softer formations.

In any event the body or bodies 102 of the reaming shell 100 whether they be in the form of pads, broaches, or other configuration can be formed from a matrix of hard particulate material, such as for example, a metal. One will appreciate in light of the disclosure herein, that the hard particular material may include a powered material, such as for example, a powered metal or alloy, as well as ceramic compounds. According to some implementations of the present invention the hard particulate material can include tungsten carbide. As used herein, the term "tungsten carbide" means any material composition that contains chemical compounds of tungsten and carbon, such as, for example, we, W2e, and combinations of we and W2e. Thus, tungsten carbide includes, for example, cast tungsten carbide, sintered tungsten carbide, and macrocrystalline tungsten. According to additional or alternative implementations of the present invention, the hard particulate material can include carbide, tungsten, iron, cobalt, and/or molybdenum and carbides, borides, alloys thereof, or any other suitable material.

The hard particulate material of the bodies 102 (i.e., pads) can be infiltrated with a binder as described herein above. The binder can provide the pads 102 with increased wear resistance, thereby increasing the life of the reaming shell 100.

Optionally, the bodies 102 (i.e., pads) of the reaming shell 100 can include also include a plurality of abrasive cutting media dispersed throughout the hard particulate material. The binder can bond to the hard particulate material and the abrasive cutting media to form the bodies 102. The binder can provide the pads 102 of the reaming shell 100 with increased wear resistance, while also not degrading any impregnated abrasive cutting media.

The abrasive cutting media can include one or more of natural diamonds, synthetic diamonds, polycrystalline diamond or thermally stable diamond products, aluminum oxide, silicon carbide, silicon nitride, tungsten carbide, cubic boron nitride, alumina, seeded or unseeded sol-gel alumina, or other suitable materials.

The abrasive cutting media used in the drilling tools of one or more implementations of the present invention can have any desired characteristic or combination of characteristics. For instance, the abrasive cutting media can be of any size, shape, grain, quality, grit, concentration, etc. In some embodiments, the abrasive cutting media can be very small and substantially round in order to leave a smooth finish on the material being cut by the bodies 102. In other implementations, the cutting media can be larger to cut aggressively into the material or formation being drill. The abrasive cutting media can be dispersed homogeneously or heterogeneously throughout the bodies 102.

Figure 2:
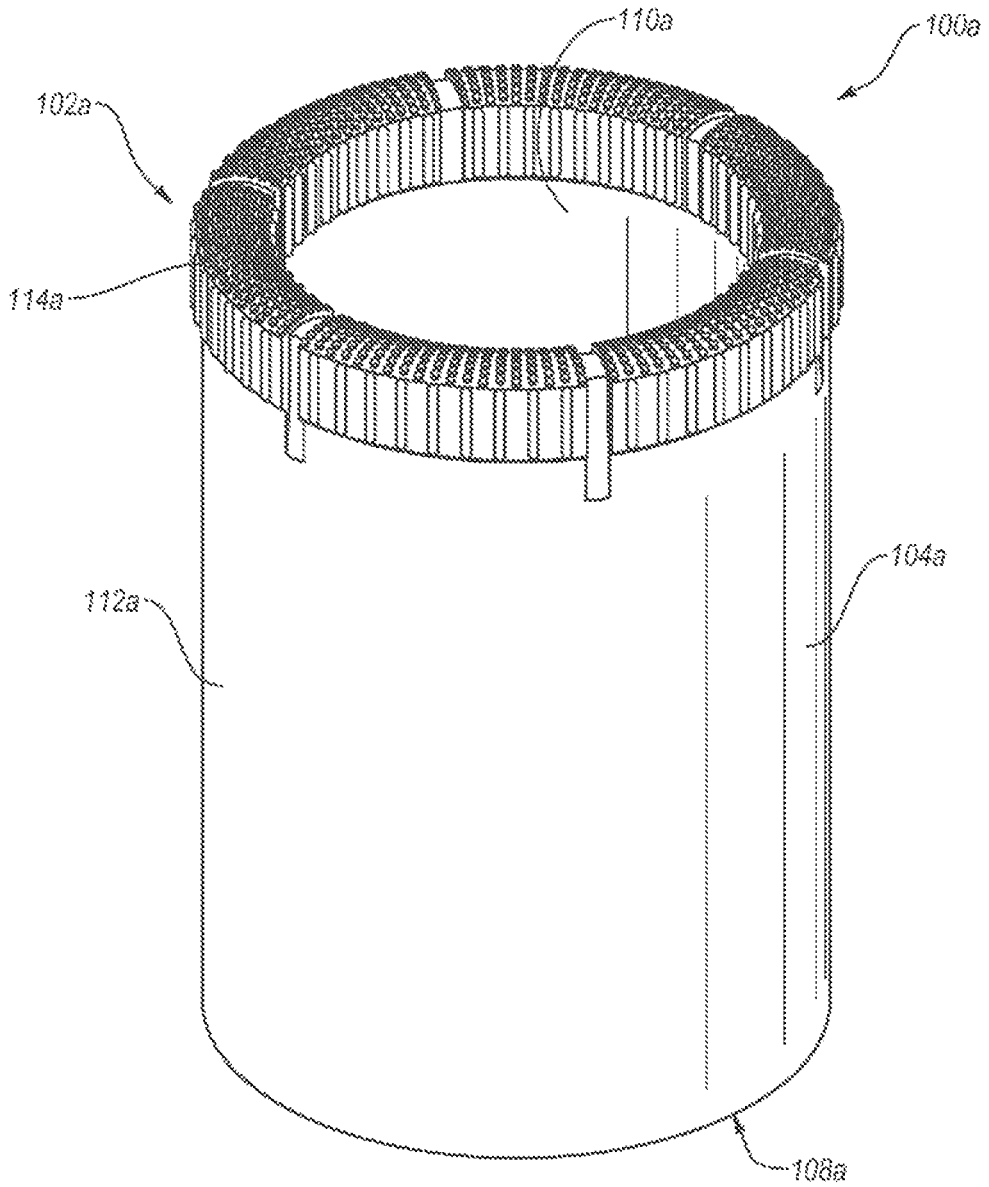
FIG. 2 illustrates a surface-set core drill bit including a binder in accordance with one or more implementations of the present invention.
Figure 3:
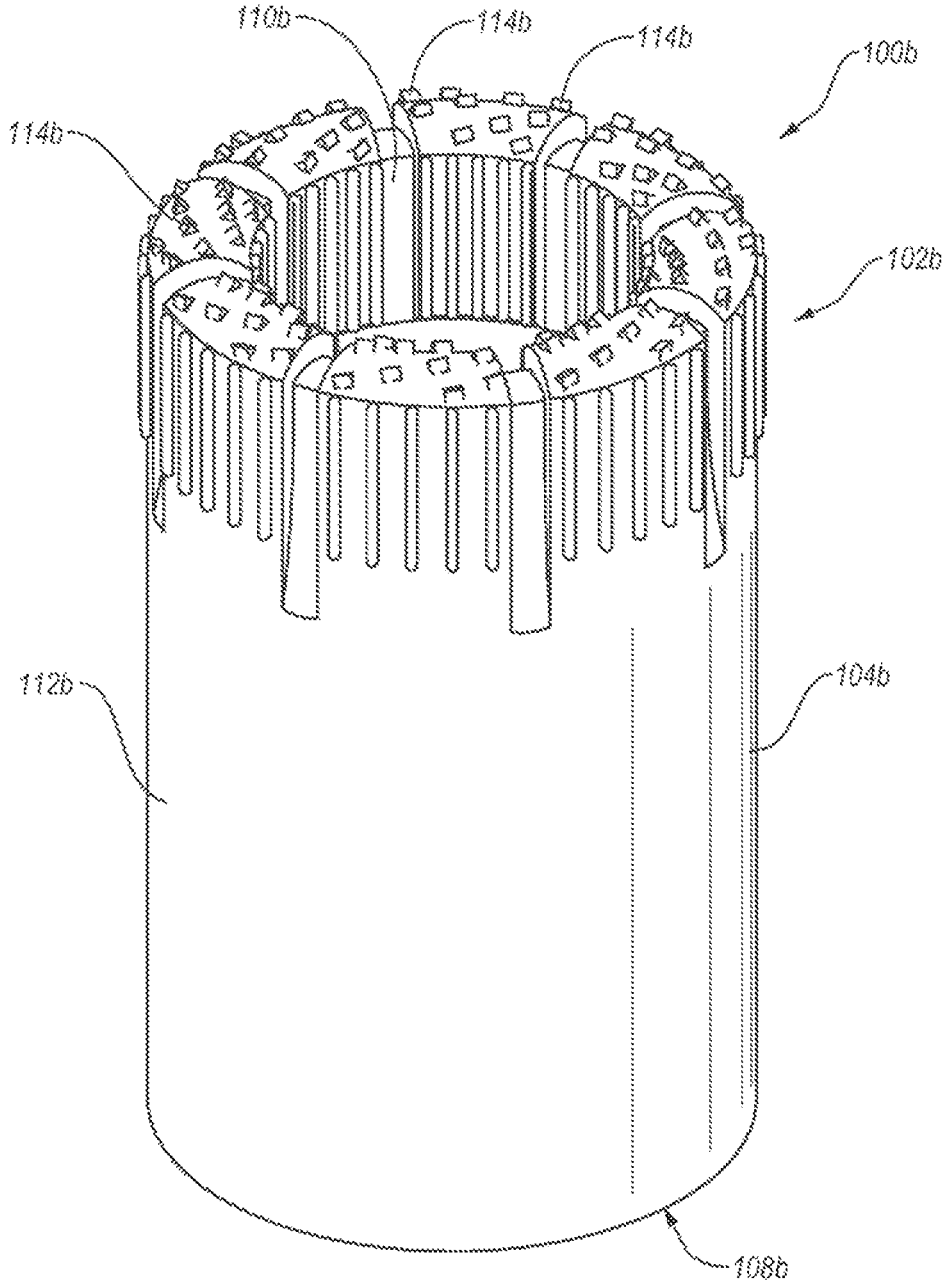
FIG. 3 illustrates a thermally-stable-diamond ("TSD") core drill bit including a binder in accordance with one or more implementations of the present invention.
Figure 4:
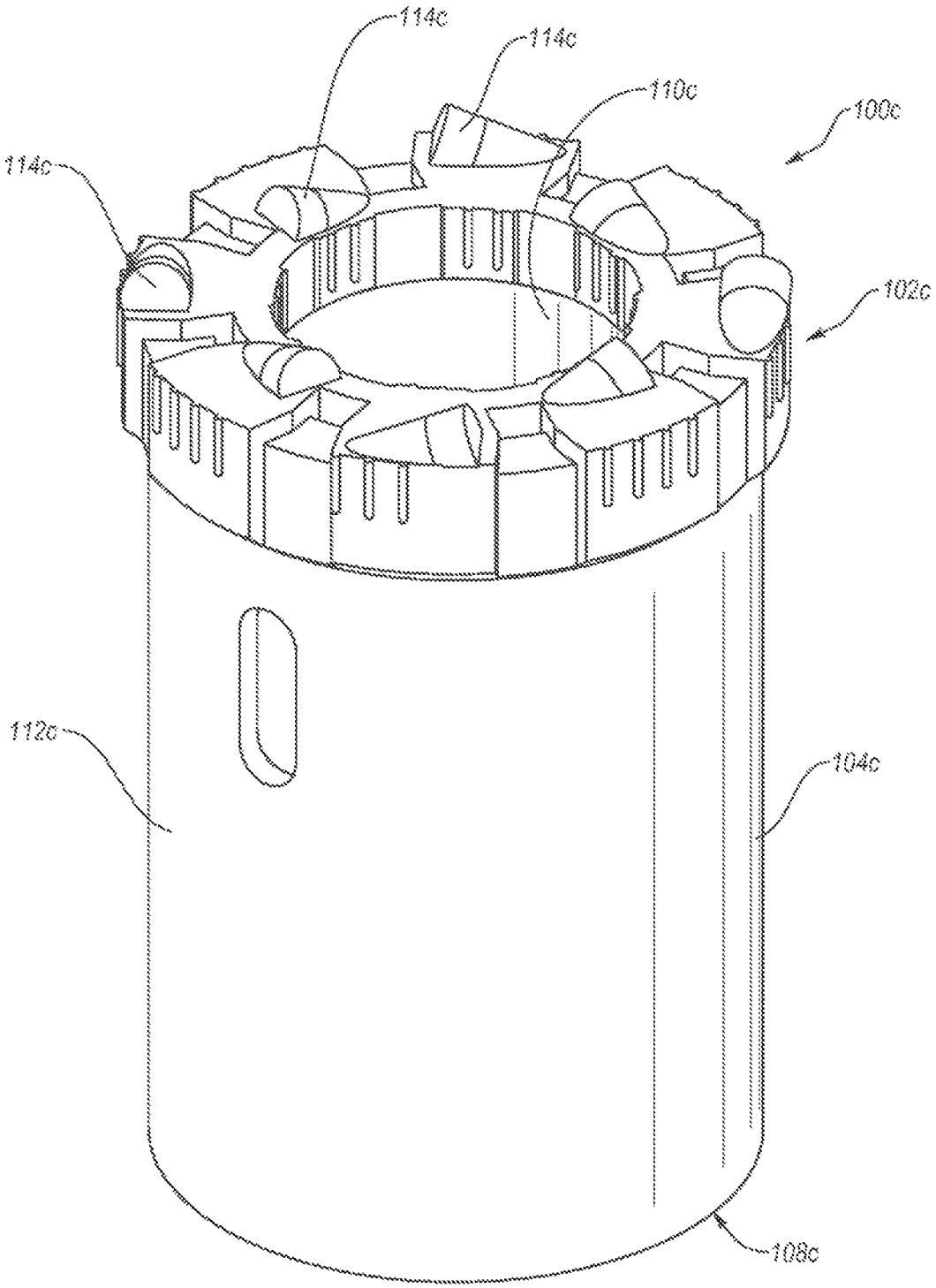
FIG. 4 illustrates a polycrystalline diamond ("PCD") core drill bit including a binder in accordance with one or more implementations of the present invention.

One will appreciate that reaming shells 100 are only one type of drilling tool with which binders of the present invention may be used. For example, FIGS. 2-4 illustrates four additional types of drilling tools which can be formed using binders of the present invention. In particular, FIG. 2 illustrates a surface set drill bit 100*a*, FIG. 3 illustrates a TSD drill bit 100*b*, and FIG. 4 illustrates a PCD drill bit 100*c*. Each of the drilling tools of FIGS. 3-5 can include a body 102*a*, 102*b*, 102*c* (i.e., bit crowns) comprising a hard particulate material, as described above, infiltrated with a binder in accordance with one or more implementations of the present invention.

Similar to the reaming shell 100, each of the drilling tools 100*a*, 100*b*, 100*c* can include a shank portion 104*a*, 104*b*, 104*c* with a first end 108*a*, 108*b*, 108*c* that is configured to connect the drilling tool 100*a*, 100*b*, 100*c* to a component of a drill string. Also, each of the drilling tools 100*a*, 100*b*, 100*c* can have a generally annular shape defined by an inner surface 100*a*, 100*b*, 100*c* and an outer surface 112*a*, 112*b*, 112*c*. Thus, the drilling tools 100*a*, 100*b*, 100*c* can define an interior space about its central axis for receiving a core sample.

In the case of the surface set drill bit 100*a* shown in FIG. 2, the annular crown 102*a* can be formed from a hard particulate material infiltrated with a binder of one or more implementations as described above. Furthermore, the crown 102*a* can include a plurality of cutting media 114*a*. The cutting media 114*a* can comprise one or more of natural diamonds, synthetic diamonds, polycrystalline diamond or thermally stable diamond products, aluminum oxide, silicon carbide, silicon nitride, tungsten carbide, cubic boron nitride, alumina, seeded or unseeded sol-gel alumina, or other suitable materials. The binder can bond to the hard particulate material and the abrasive cutting media to form the body 102*a*. The binder can provide the crown 102*a* with increased wear resistance, while also not degrading any surface set cutting media.

In the case of the TSD drill bit 100*b* and the PCD drill bit 100*c*, the annular crowns 102*b*, 102*c* can be formed from a hard particulate material infiltrated with a binder of one or more implementations as described above. Furthermore, the crowns 102*b*, 102*c* can include a plurality of TSD cutters 114*b* or PCD cutters 114*c*, respectively. The TSD cutters 114*b* or PCD cutters 114*c* can be brazed or soldered to the crown 102*b*, 102*c* using a binder of one or more implementations of the present invention. Alternatively, the TSD cutters 114*b* or PCD cutters 114*c* can be brazed or soldered to the crown 102*b*, 102*c* using another binder, braze, or solder.

Figure 5:
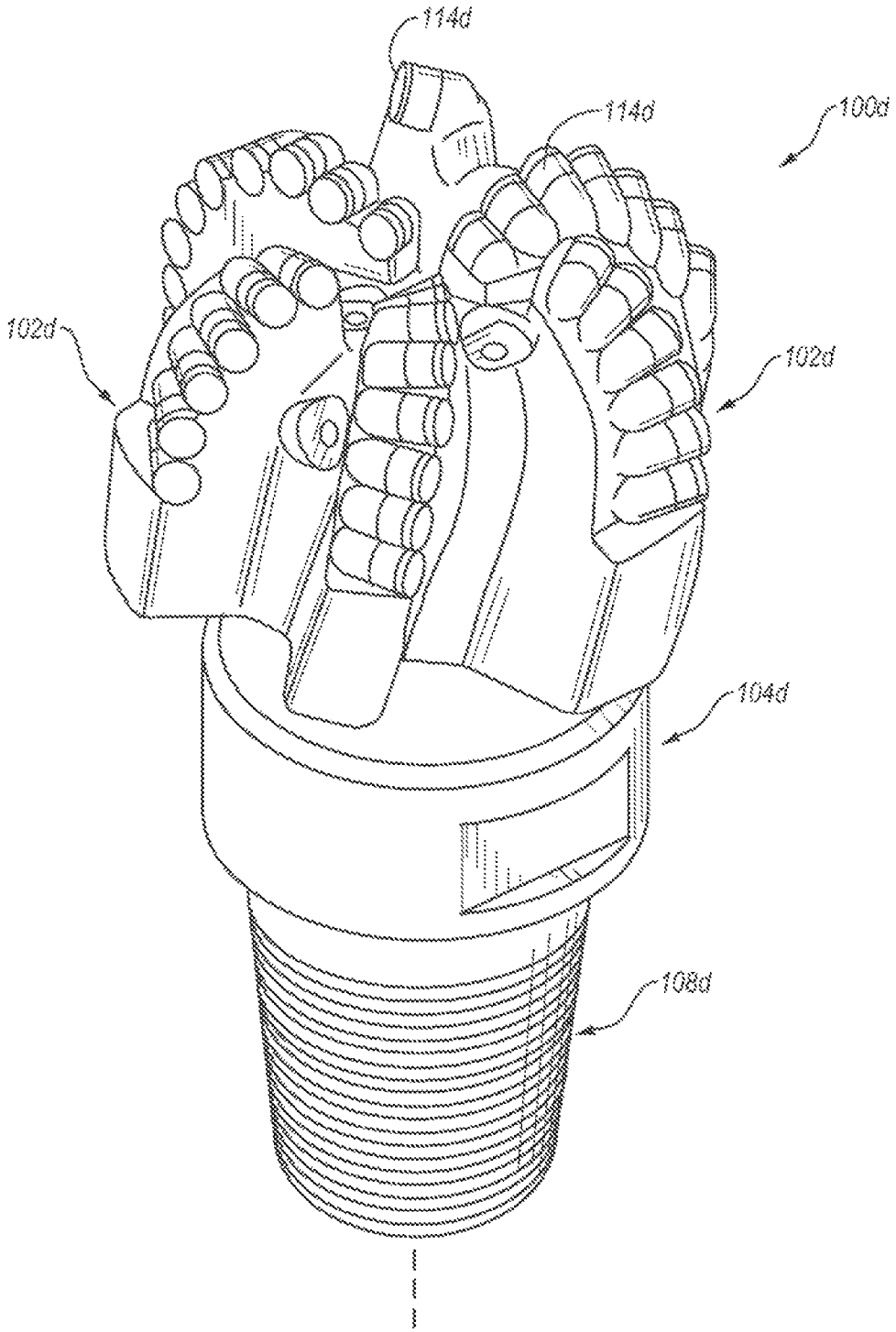
FIG. 5 illustrates a PCD rotary drill bit including a binder in accordance with one or more implementations of the present invention.

The drilling tools shown and described in relation to FIGS. 1-4 have been coring drilling tools. One will appreciate that the binders of the present invention can be used to form other non-coring drilling tools. For example, FIG. 5 illustrates a drag drill bit 100*d* including one or more bodies 102*d* formed from a hard particulate material infiltrated with a binder of the present invention. In particular, FIG. 5 illustrates a plurality of blades 102*d* from a hard particulate material infiltrated with a binder of the present invention. Each of the blades 102*d* can include one or more PCD cutters 114*d* or other cutter brazed or soldered to the blades 102*d*. The drag drill bit 100*d* can further include a shank 104*d* and a first end 108*d* similar to those described herein above.

One will appreciate the crown 102*c* and blades 102*d* shown in FIGS. 4 and 5 can have an increased drilling life due to the binders of the present invention used to form them. This can allow a driller to replace the cutters 114*c*, 114*d* multiple times before having to replace the drill bit 100*c*, 100*d*.

Figure 6:
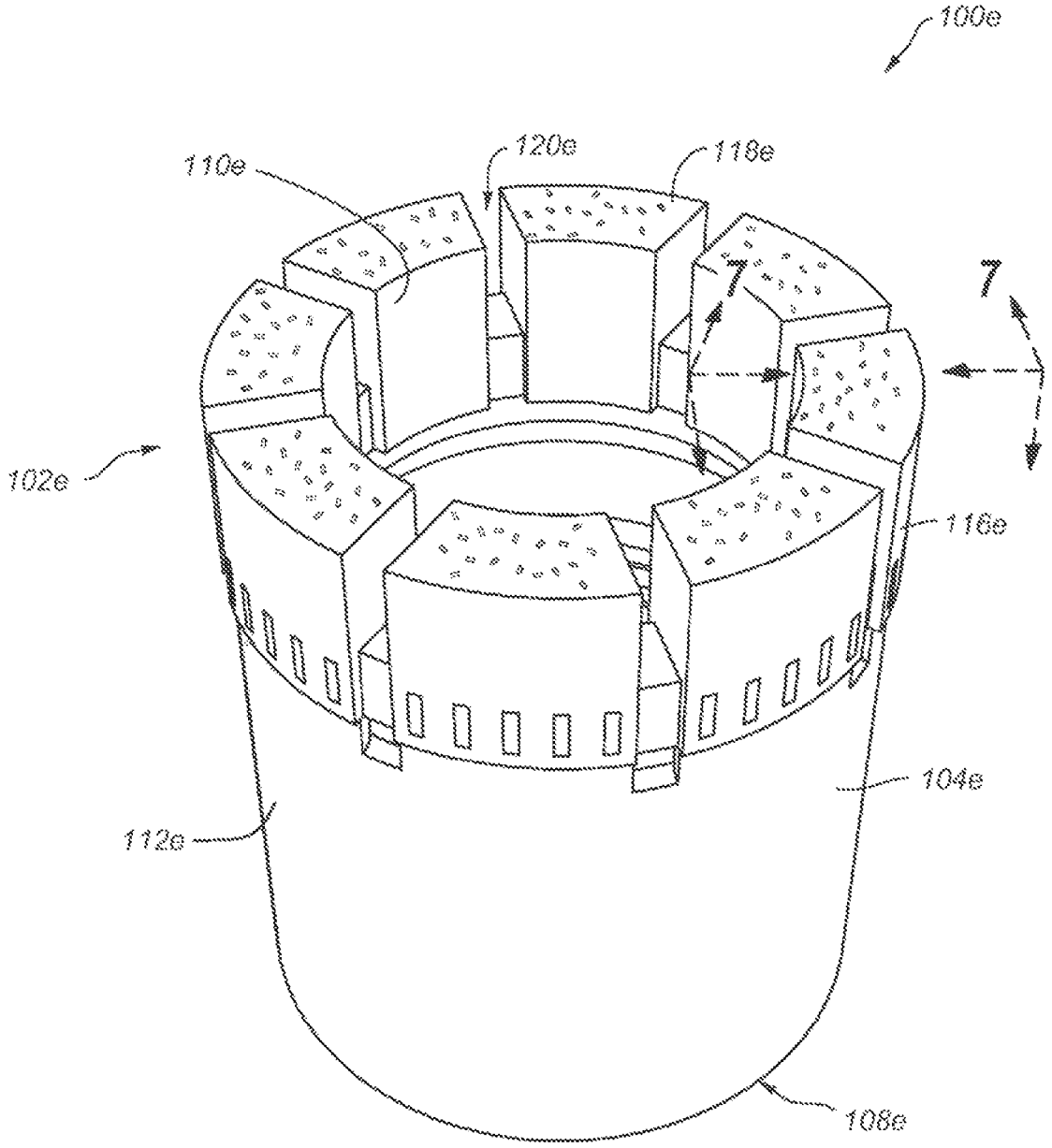
FIG. 6 illustrates an impregnated core drill bit including a binder in accordance with one or more implementations of the present invention.
Figure 7:
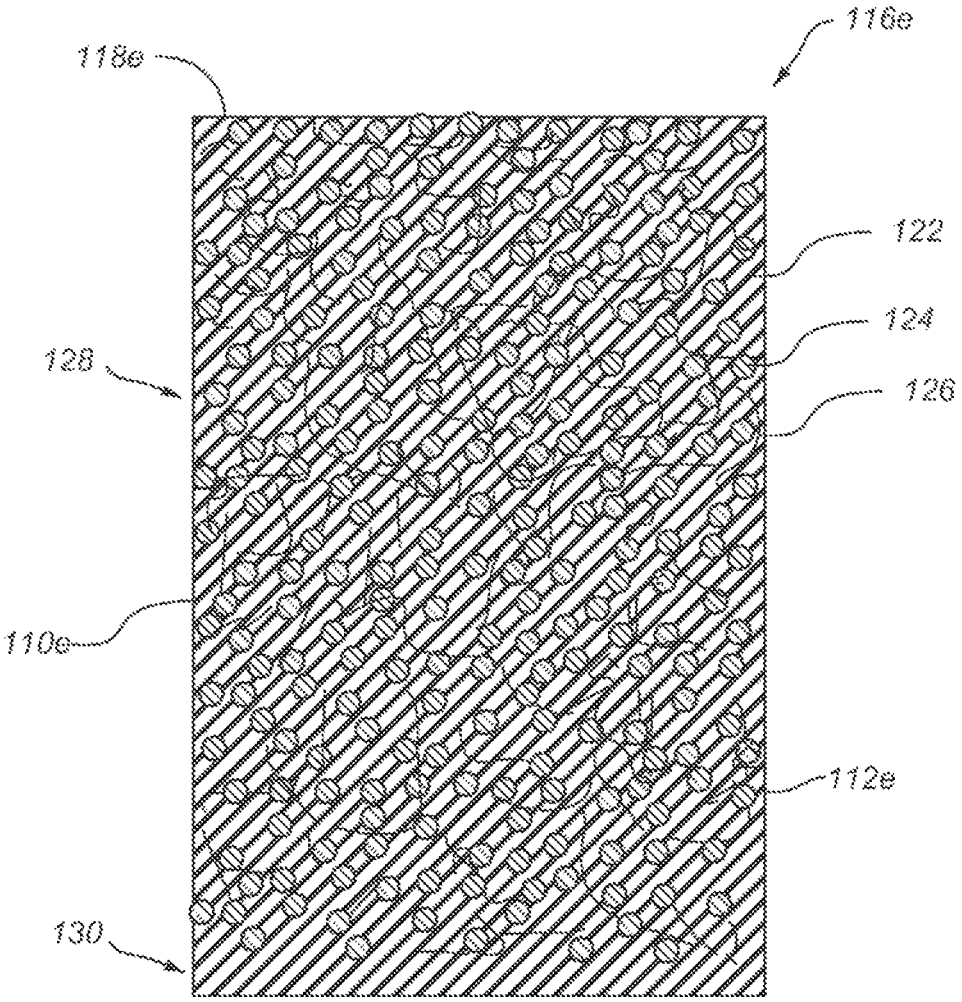
FIG. 7 illustrates a cross-sectional view of a cutting portion of the impregnated core drill bit of FIG. 6 taken along the line 7-7 of FIG. 6.

The binders of the present invention may also be used with impregnated cutting tools. For example, FIGS. 6 and 7 illustrates views of an impregnated, core-sampling drill bit 100*e* having a body or crown 102*e* formed with a binder of the present invention. Similar to the other coring drilling tools 102, 102*a*, 102*b*, 102*c*, the impregnated, core-sampling drill bit 100*e* can include a shank portion 104*e* with a first end 108*e* that is configured to connect the impregnated, core-sampling drill bit 100*e* to a component of a drill string. Also, the impregnated, core-sampling drill bit 100*e* can have a generally annular shape defined by an inner surface 110*e* and an outer surface 112*e*. Thus, the impregnated, core-sampling drill bit 100*e* can thus define an interior space about its central axis for receiving a core sample.

The crown 102 of the impregnated, core-sampling drill bit 100*e* can be configured to cut or drill the desired materials during drilling processes. In particular, the crown 102 of the impregnated, core-sampling drill bit 100*e* can include a cutting face 118*e*. The cutting face 118*e* can include waterways or spaces 120*e* which divide the cutting face 118*e* into cutting elements 116*e*. The waterways 120*e* can allow a drilling fluid or other lubricants to flow across the cutting face 118*e* to help provide cooling during drilling.

The construction of the cutting section of an impregnated drilling tool can directly relate to its performance. The crown or cutting section of an impregnated drilling tool typically contains diamonds and/or other hard materials distributed within a suitable supporting matrix. Metal-matrix composites are commonly used for the supporting matrix material. Metal-matrix materials usually include a hard particulate phase with a ductile metallic phase (i.e., binder). The hard phase often consists of tungsten carbide and other refractory elements or ceramic compounds.

For example, referring now to FIG. 7, an enlarged cross-sectional view the cutting section 116*e* of the impregnated, core-sampling drill bit 100*e* is shown. In one or more implementations, the cutting section 116*e* of the impregnated, core-sampling drill bit 100*e* can be made of one or more layers. For example, the cutting section 116*e* can include two layers. In particular, the cutting section 116*e* can include a matrix layer 128, which performs the cutting during drilling, and a backing layer or base 130, which connects the matrix layer 128 to the shank portion 104*e* of the impregnated, core-sampling drill bit 100*e*.

FIG. 7 further illustrates that the cutting section or crown 116*e* of the impregnated, core-sampling drill bit 100*e* can comprise a matrix 122 of hard particulate material and a binder of one or more implementations of the present invention.

The cutting section or crown 116*e* can also include a plurality of abrasive cutting media 124 dispersed throughout the matrix 122. The abrasive cutting media 124 can include one or more of natural diamonds, synthetic diamonds, polycrystalline diamond products (i.e., TSD or PCD), aluminum oxide, silicon carbide, silicon nitride, tungsten carbide, cubic boron nitride, alumina, seeded or unseeded sol-gel alumina, or other suitable materials. In one or more implementations, the abrasive cutting media 124 can be very small and substantially round in order to leave a smooth finish on the material being cut by the core sampling impregnated, core-sampling drill bit 100*e*. In alternative implementations, the cutting media 124 can be larger to cut aggressively into the material being cut.

The abrasive cutting media 124 can be dispersed homogeneously or heterogeneously throughout the cutting section 116*e*. As well, the abrasive cutting media 124 can be aligned in a particular manner so that the drilling properties of the cutting media 124 are presented in an advantageous position with respect to the cutting section 116*c* of the impregnated, core-sampling drill bit 100*e*. Similarly, the abrasive cutting media 124 can be contained in the in a variety of densities as desired for a particular use.

In addition to abrasive cutting media 124, the cutting section 116*e* can include a plurality of elongated structures 126 dispersed throughout the matrix 122. The addition of elongated structures 126 can be used to tailor the properties of the cutting section 116*e* of the impregnated, core-sampling drill bit 100*e*. For example, elongated structures 126 can be added to the matrix 122 material to interrupt crack propagation, and thus, increase the tensile strength and decrease the erosion rate of the matrix 122.

Additionally, the addition of elongated structures 126 may also weaken the structure of the cutting section 116*e* by at least partially preventing the bonding and consolidation of some of the abrasive cutting media 124 and hard particulate material of the matrix 122 by the binder. Thus, when using a binder of the present invention, the addition of elongated structures 126 can help reduce the effective strength of the binder to ensure that the crown 102*e* will erode and expose additional abrasive cutting media 124, while also retaining the increased wear resistance associated with the increased hardness of the binder As shown by FIG. 7, both the elongated structures 126 and the cutting media 124 can be dispersed within the matrix 122 between the cutting face 118*e* and the base 130. As an impregnated drilling tool, the matrix 122 can be configured to erode and expose cutting media 124 and elongated structures 126 initially located between the cutting face 118*e* and the base 130 during drilling. The continual expose of new cutting media 124 can help maintain a sharp cutting face 118*e*.

Exposure of new elongated structures 126 can help reduce frictional heating of the drilling tool. For example, once the elongated structures 126 are released from the matrix 122 drilling they can provide cooling effects to the cutting face 118*e* to reduce friction and associated heat. Thus, the elongated structures 126 can allow for tailoring of the cutting section 116*e* to reduce friction and increase the lubrication at the interface between the cutting portion and the surface being cut, allowing easier drilling. This increased lubrication may also reduce the amount of drilling fluid additives (such as drilling muds, polymers, bentonites, etc.) that are needed, reducing the cost as well as the environmental impact that can be associated with using drilling tools.

The elongated structures 126 can be formed from carbon, metal (e.g., tungsten, tungsten carbide, iron, molybdenum, cobalt, or combinations thereof), glass, polymeric material (e.g., Kevlar), ceramic materials (e.g., silicon carbide), coated fibers, and/or the like. Furthermore, the elongated structures 126 can optionally be coated with one or more additional material(s) before being included in the drilling tool. Such coatings can be used for any performance-enhancing purpose. For example, a coating can be used to help retain elongated structures 126 in the drilling tool. In another example, a coating can be used to increase lubricity near the drilling face of a drilling tool as the coating erodes away and forms a fine particulate material that acts to reduce friction. In yet another example, a coating can act as an abrasive material and thereby be used to aid in the drilling process.

Any known material can be used to coat the elongated structures 126. For example, any desired metal, ceramic, polymer, glass, sizing, wetting agent, flux, or other substance could be used to coat the elongated structures 126. In one example, carbon elongated structures 126 are coated with a metal, such as iron, titanium, nickel, copper, molybdenum, lead, tungsten, aluminum, chromium, or combinations thereof. In another example, carbon elongated structures 126 can be coated with a ceramic material, such as SiC, SiO, $SiO_2$, or the like.

Where elongated structures 126 are coated with one or more coatings, the coating material can cover any portion of the elongated structures 126 and can be of any desired thickness. Accordingly, a coating material can be applied to the elongated structures 126 in any manner known in the art. For example, the coating can be applied to elongated structures 126 through spraying, brushing, electroplating, immersion, physical vapor deposition, or chemical vapor deposition.

Additionally, the elongated structures 126 can also be of varying combination or types. Examples of the types of elongated structures 126 include chopped, milled, braided, woven, grouped, wound, or tows. In one or more implementations of the present invention, such as when the drilling tool comprises a core sampling impregnated, core-sampling drill bit 100*e*, the elongated structures 126 can contain a mixture of chopped and milled fibers. In alternative implementations, the drilling tool can contain one type of elongated structure 126. In yet additional implementations, however, the drilling tool can contain multiple types of elongated structures 126. In such instances, where a drilling tool contains more than one type of elongated structures 126, any combination of type, quality, size, shape, grade, coating, and/or characteristic of elongated structures 126 can be used.

The elongated structures 126 can be found in any desired concentration in the drilling tool. For instance, the cutting section 116*e* of a drilling tool 20 can have a very high concentration of elongated structures 126, a very low concentration of fibers, or any concentration in between. In one or more implementations the drilling tool can contain elongated structures 126 ranging from about 0.1 to about 25% by weight. In further implementations, the crown 102*e* can comprise between about 1% and about 15% addition by weight of elongated structures. In particular, the crown 102*e* can comprise about 3%, 4%, 5%, 6%, 7%, 8%, 9% or 10% addition by weight of elongated structures.

According to some implementations of the present invention when the composition of the binder is tailored to increase tensile strength, the amount of elongated structures 126 can be adjusted to ensure that the cutting section erodes at a proper and consistent rate. In other words, the cutting portion can be configured to ensure that it erodes and exposes new abrasive cutting media during the drilling process. In this way, the cutting section 116*e* may be custom-engineered to possess optimal characteristics for drilling specific materials by varying the strength of the binder and/or concentration of the elongated structures 126. For example, a hard, abrasion resistant matrix may be made to drill soft, abrasive, unconsolidated formations, while a soft ductile matrix may be made to drill an extremely hard, non-abrasive, consolidated formation. Thus, the bit matrix hardness may be matched to particular formations, allowing the cutting section 22 to erode at a controlled, desired rate.

In one or more implementations, elongated structures 126 can be homogenously dispersed throughout the cutting section 116*e*. In other implementations, however, the concentration of elongated structures 126 can vary throughout the cutting section 116*e*, as desired. The elongated structures 126 can be located in the cutting section 116*e* of a drilling tool in any desired orientation or alignment. In one or more implementations, the elongated structures 126 can run roughly parallel to each other in any desired direction. FIG. 7 illustrates that, in other implementations, the elongated structures 126 can be randomly configured and can thereby be oriented in practically any or multiple directions relative to each other.

The elongated structures 126 can be of any size or combination of sizes, including mixtures of different sizes. For instance, elongated structures 126 can be of any length and have any desired diameter. In some implementations, the elongated structures 126 can be nano-sized. In other words a diameter of the elongated structures 126 can be between about 1 nanometer and about 100 nanometers. In alternative implementations, the elongated structures 126 can be micro-sized. In other words, diameter of the elongated structures 126 can be between about 1 micrometer and about 100 micrometer. In yet additional implementations, the diameter of the elongated structures 126 can be between about less than about 1 nanometer or greater than about 100 micrometers.

Additionally, the elongated structures 126 can have a length between about 1 nanometer and about 25 millimeters. In any event, the elongated structures 126 can have a length to diameter ratio between about 2 to 1 and about 500,000 to 1. More particularly, the elongated structures 126 can have a length to diameter ratio between about 10 to 1 and about 50 to 1.

Implementations of the present invention also include methods of forming impregnated drill bits including high strength, high hardness binders. The following describes at least one method of forming drilling tools with binders of the present invention. Of course, as a preliminary matter, one of ordinary skill in the art will recognize that the methods explained in detail herein can be modified. For example, various acts of the method described can be omitted or expanded, and the order of the various acts of the method described can be altered as desired.

Figure 8:
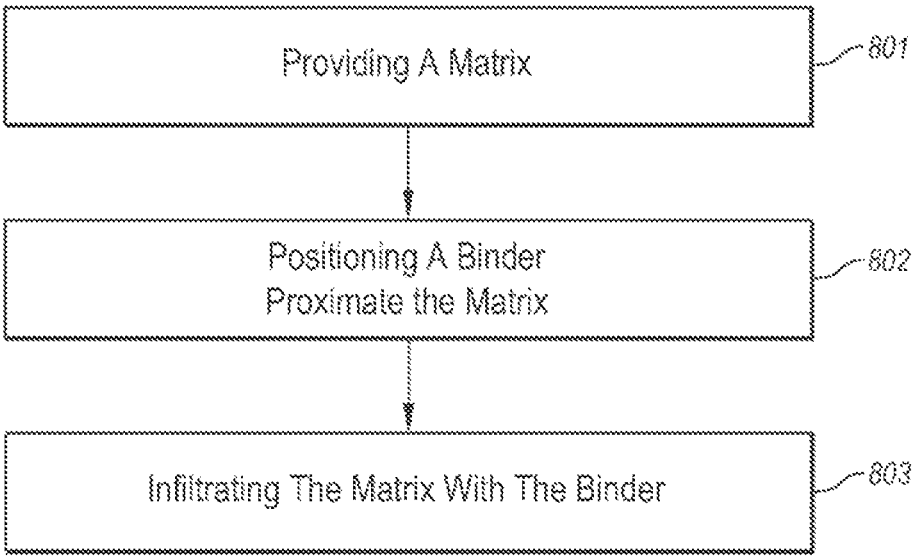
FIG. 8 illustrates a chart of acts and steps in a method of forming a drilling tool using a high-strength, high-hardness binder in accordance with an implementation of the present invention.

For example, FIG. 8 illustrates a flowchart of one exemplary method for producing a drilling tool using binders of the present invention. The acts of FIG. 8 are described below with reference to the components and diagrams of FIGS. 1 through 7.

As an initial matter, the term "infiltration" or "infiltrating" as used herein involves melting a binder material and causing the molten binder to penetrate into and fill the spaces or pores of a matrix. Upon cooling, the binder can solidify, binding the particles of the matrix together. The term "sintering" as used herein means the removal of at least a portion of the pores between the particles (which can be accompanied by shrinkage) combined with coalescence and bonding between adjacent particles.

For example, FIG. 8 shows that a method of forming a drilling tool 100-100*e* can comprise an act 801 of providing or preparing a matrix 122. In particular, the method can involve preparing a matrix of hard particulate material. For example, the method can comprise preparing a matrix of a powered material, such as for example tungsten carbide. In additional implementations, the matrix can comprise one or more of the previously described hard particulate materials. In some implementations of the present invention, the method can include placing the matrix in a mold.

The mold can be formed from a material that is able to withstand the heat to which the matrix 122 will be subjected to during a heating process. In at least one implementation, the mold may be formed from carbon or graphite. The mold can be shaped to form a drill bit having desired features. In at least one implementation of the present invention, the mold can correspond to a core drill bit.

In addition, the method can optionally comprise an act of dispersing a plurality of abrasive cutting media 124 and/or elongated structures 126 throughout at least a portion the matrix. Additionally, the method can involve dispersing the abrasive cutting media 124 and/or elongated structures 126 randomly or in an unorganized arrangement throughout the matrix 122.

FIG. 8 further illustrates that the method can involve an act 802 if positioning a binder proximate the matrix. For example, the method can involve placing a binder as described hereinabove on top of the matrix 122 once it is positioned in a mold.

In one or more implementations, the hard particulate material can comprise between about 25% and about 85% by weight of the body 102-102*e*. More particularly, the hard particulate material can comprise between about 25% and about 85% by weight of the body 102-102*e*. For example, a body 102-102*e* of one or more implementations of the present invention can include between about 25% and 60% by weight of tungsten, between about 0% and about 4% by weight of silicon carbide, and between about 0% and about 4% by weight of tungsten carbide.

The elongated structures can comprise between about 0% and 25% by weight of the body 102-102*e*. More particularly, the elongated structures can comprises between about 1% and about 15% by weight of the body 102-102*e*. For example, a body 102-102*e* of one or more implementations of the present invention can include between about 3% and about 6% by weight of carbon nanotubes.

The cutting media can comprise between about 0% and about 25% by weight of the body 102-102*e*. More particularly, the cutting media can comprise between about 5% and 15% by weight of the body 102-102*e*. For example, a body 102-102*e* of one or more implementations of the present invention can include between about 5% and about 12.5% by weight of diamond crystals.

The method can comprise an act 803 of infiltrating the matrix with the binder. This can involve heating the binder to a molten state and infiltrating the matrix with the molten binder. For example, the binder can be heated to a temperature sufficient to bring the binder to a molten state. At which point the molten binder can infiltrate the matrix 122. In one or more implementations, the method can include heating the matrix 122, cutting media 124, elongated structures 122, and the binder to a temperature of at least the liquidus temperature of the binder. The binder can cool thereby bonding to the matrix 122, cutting media 124, elongated structures 126, together. The binder can comprise between about 15% and about 55% by weight of the body 102-102*e*. More particularly, the binder can comprise between about 20% and about 45% by weight of the body 102-102*e*.

According to some implementations of the present invention, the time and/or temperature of the infiltration process can be increased to allow the binder to fill-up a greater number and greater amount of the pores of the matrix. This can both reduce the shrinkage during infiltration, and increase the strength of the resulting drilling tool.

Additionally, that the method can comprise an act of securing a shank 104 to the matrix 122 (or body 102-102*e*). For example, the method can include placing a shank 104 in contact with the matrix 122. A backing layer 130 of additional matrix, binder material, and/or flux may then be added and placed in contact with the matrix 122 as well as the shank 104 to complete initial preparation of a green drill bit. Once the green drill bit has been formed, it can be placed in a furnace to thereby consolidate the drill bit. Alternatively, the first and second sections can be mated in a secondary process such as by brazing, welding, or adhesive bonding. Still further, additional cutters can be brazed or otherwise attached to the drill bit. Thereafter, the drill bit can be finished through machine processes as desired.

Before, after, or in tandem with the infiltration of the matrix 122, one or more methods of the present invention can include sintering the matrix 122 to a desired density. As sintering involves densification and removal of porosity within a structure, the structure being sintered can shrink during the sintering process. A structure can experience linear shrinkage of between 1% and 40% during sintering. As a result, it may be desirable to consider and account for dimensional shrinkage when designing tooling (molds, dies, etc.) or machining features in structures that are less than fully sintered.

Accordingly, the schematics and methods described herein provide a number of unique products that can be effective for drilling through both soft and hard formations. Additionally, such products can have an increased drilling penetration rate due to the relatively large abrasive cutting media. Furthermore, as the relatively large abrasive cutting media can be dispersed throughout the crown, new relatively large abrasive cutting media can be continually exposed during the drilling life of the impregnated drill bit.

The present invention can thus be embodied in other specific forms without departing from its spirit or essential characteristics. For example, the impregnated drill bits of one or more implementations of the present invention can include one or more enclosed fluid slots, such as the enclosed fluid slots described in U.S. patent application Ser. No. 11/610,680, filed Dec. 14, 2006, entitled "Core Drill Bit with Extended Crown Longitudinal dimension," now U.S. Pat. No. 7,628,228, the content of which is hereby incorporated herein by reference in its entirety. Still further, the impregnated drill bits of one or more implementations of the present invention can include one or more tapered waterways, such as the tapered waterways described in U.S. patent application Ser. No. 12/638,229, filed Dec. 15, 2009, entitled "Drill Bits With Axially-Tapered Waterways," the content of which is hereby incorporated herein by reference in its entirety. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A body of a drilling tool, comprising:
a hard particulate material; and
a binder, the binder comprising:
about 5 to about 50 weight % of nickel;
about 35 to about 60 weight % of zinc; and
about 0.5 to about 35 weight % of tin,
wherein the binder does not comprise copper.

2. The body of a drilling tool as recited in claim 1, wherein the binder comprises about 5 to about 30 weight % of nickel.

3. The body of a drilling tool as recited in claim 1, wherein the binder consists of:
about 5 to about 50 weight % of nickel;
about 35 to about 60 weight % of zinc;
about 1 to about 10 weight % of tin; and
about 0 to about 20 weight % of additional components.

4. The body of a drilling tool as recited in claim 3, wherein the additional components comprise one or more of aluminum, iron, lead, manganese, silicon, phosphorous, boron, silver, gold, or gallium.

5. The body of a drilling tool as recited in claim 2, wherein the binder consists essentially of nickel, zinc, and tin.

6. The body of a drilling tool as recited in claim 1, wherein the drilling tool comprises one of a reamer, a reaming shell, a surface set drill bit, a PCD drill bit, or a diamond impregnated drill bit.

7. The body of a drilling tool as recited in claim 6, further comprising a plurality of abrasive cutting media dispersed throughout the body.

8. The body of a drilling tool as recited in claim 7, wherein the abrasive cutting media comprise one or more of natural diamonds, synthetic diamonds, aluminum oxide, silicon carbide, silicon nitride, tungsten carbide, cubic boron nitride, alumina, or seeded or unseeded sol-gel alumina.

9. The body of a drilling tool as recited in claim 1, wherein the binder comprises about 10 weight % of nickel.

10. The body of a drilling tool as recited in claim 1, wherein the binder comprises about 35 to about 50 weight % of zinc.

11. The body of a drilling tool as recited in claim 1, wherein the binder comprises about 1 to about 10 weight % of tin.

12. The body of a drilling tool as recited in claim 1, wherein the binder comprises about 4 to about 15 weight % of tin.

13. A body of a drilling tool, comprising:
a hard particulate material; and
a binder, wherein the binder consists of:
about 5 to about 50 weight % of nickel;
about 35 to about 60 weight % of zinc;
about 4 to about 15 weight % of tin;
about 0 to about 55 weight % of copper; and
silicon, wherein the silicon comprises less than 5 weight % of the binder.

14. The body of a drilling tool as recited in claim 13, wherein the binder consists of:
about 5 to about 30 weight % of nickel;
about 35 to about 60 weight % of zinc;
about 4 to about 15 weight % of tin;
about 0 to about 55 weight % of copper; and
silicon, wherein the silicon comprises less than 5 weight % of the binder.

15. The body of a drilling tool as recited in claim 13, wherein the binder consists of:
about 10 weight % of nickel;
about 35 to about 60 weight % of zinc;
about 4 to about 15 weight % of tin;
about 0 to about 55 weight % of copper; and
silicon, wherein the silicon comprises less than 5 weight % of the binder.

16. The body of a drilling tool as recited in claim 13, wherein the binder consists of:
about 5 to about 50 weight % of nickel;
about 35 to about 50 weight % of zinc;
about 4 to about 15 weight % of tin;
about 0 to about 55 weight % of copper; and
silicon, wherein the silicon comprises less than 5 weight % of the binder.

17. The body of a drilling tool as recited in claim 13, wherein the drilling tool comprises one of a reamer, a reaming shell, a surface set drill bit, a PCD drill bit, or a diamond impregnated drill bit.

18. The body of a drilling tool as recited in claim 17, further comprising a plurality of abrasive cutting media dispersed throughout the body.

* * * * *